United States Patent [19]

Gilda et al.

[11] Patent Number: 4,577,758

[45] Date of Patent: Mar. 25, 1986

[54] ASHTRAY

[76] Inventors: Patricia Gilda, 6 Hermann Dr., Monterey, Calif. 93940; William F. Mann, 25 Main St.; Winthrop D. Allen, III, 25 Clawson St., both of Bisbee, Ariz. 85603

[21] Appl. No.: 735,799

[22] Filed: May 17, 1985

[51] Int. Cl.[4] ..... B65D 73/00

[52] U.S. Cl. ..... 206/496; 206/135; 206/136; 206/120; 206/246; 53/396

[58] Field of Search ..... 206/135, 136, 120, 246, 206/496; 53/396

[56] References Cited

U.S. PATENT DOCUMENTS

| | | | |
|---|---|---|---|
| 1,816,049 | 7/1931 | Larner | 206/496 |
| 2,720,903 | 10/1955 | Pickren | 206/496 |
| 2,796,067 | 6/1957 | McCutcheon et al. | 206/496 |
| 3,561,670 | 2/1971 | Segal | 206/496 |

FOREIGN PATENT DOCUMENTS

| | | | |
|---|---|---|---|
| 2235575 | 1/1975 | France | 206/496 |

*Primary Examiner*—Joseph Man-Fu Moy

*Attorney, Agent, or Firm*—Majestic, Gallagher, Parsons & Siebert

[57] ABSTRACT

The ashtray of this invention comprises a folded member having a substantially V-shaped cross-section formed by two panels with a common side. The adjoining sides of the two panels contiguous to the common side are adapted for contact with a supporting surface to support the panels thereon in an upright position, the two sides defining the bottom side of the ashtray. The two panels then define an angular space there between, the angular space having an apical portion near the common side of the panels. The ashtray further comprises an upper member connected to the two panels for supporting cigarettes or cigars in substantially horizontal positions. The upper member is spaced apart from the common side of the panels to allow the lighted ends of cigarettes or cigars to protrude into the apical portion and to allow ashes from such lighted ends to fall through the apical portion towards the bottom side of the ashtray.

12 Claims, 16 Drawing Figures

ASHTRAY

BACKGROUND OF THE INVENTION

This invention relates in general to refuse receptacles and in particular to ashtrays.

For smokers in public establishments such as bars, restaurants, hotels, conference centers and offices, it is desirable to have available ashtrays which are light weight, safe and easy to handle. For those who own and operate such public establishments the cost and inconvenience of providing and cleaning ashtrays, and the cost of replacing stolen ashtrays frequently inhibit them from providing adequate numbers of ashtrays to meet smokers' needs.

People who enjoy outdoor activities such as camping, fishing, and people who travel in vehicles have also experienced the need for safe and convenient ashtrays. It is thus desirable to provide ashtrays that are easy to use, carry and dispose. Collapsible and disposable ashtrays are particularly desirable.

A number of disposable ashtrays have been proposed. In U.S. Pat. No. 2,071,394 Douglas discloses an ashtray which is constructed similar to paperbox construction. A flat piece of material is creased at several places. The end pieces are lapped together and fastened by gluing. When assembled the ashtray is in a shape of a cup with an inverted triangular cross-section. The ashtray has two legs, one on each side to support the ashtray in an upright position. The ashtray may be folded to make a flat assembly and has cut out holes forming rests for cigarettes. In the patent Douglas also disclosed a second embodiment somewhat similar to the one already described but whose leg portions have extensions which are folded across the end of the tray to be interlocked with each other forming a more rigid structure.

In U.S. Pat. No. 1,364,556 Hurff discloses an ash receiver generally in the shape of a cup with an inverted triangular cross-section. The cup is supported by foldable members on two sides which are in turn supported by a flat base formed by foldable sections. Thus, when the base is folded upwards along the center line the two support members for the cup and the cup itself are all folded into a flat package. A pivoted clip member is used to hold the base flat and the two supporting members in the extended position to support the cup in the unfolded position when the receiver is in use. The receiver provided by Hurff, however, does not allow a smoker to place a cigarette or cigar on the receiver in a horizontal position. This may cause the lighted end of the cigarette or cigar to fall into the receiver and be extinguished. Furthermore, the receiver requires flexible strip members to serve as the hinge connecting the two sections of the base and a pivoted clip member to keep the whole assembly in position so that the receiver may be expensive to manufacture.

In U.S. Pat. No. 1,430,720 Bowerman discloses a receptacle formed by a circular piece of paper with metal strips fastened in radial positions onto the paper. The metal strips are bent at points between the center and edge of the paper to form a dish with a circular base and a wall in a fluted shape. Before the receptacle disclosed by Bowerman can be used, however, the smoker or the operator of a public establishment will have to first bend the metal strips. The receptacle, therefore, appears to be inconvenient for smokers and requires extra labor for public establishment operators.

Still other foldable and disposable ashtrays have been proposed. In U.S. Pat. No. 3,342,317 Barron discloses a foldable ashtray made from a flat piece of material. To assemble the ashtray from the flat material, however, a complicated procedure is required.

Refuse and ash receivers in the form of pouches are disclosed in U.S. Pat. Nos. 2,432,656 to Cook; 3,372,724 to Rouse and in 3,561,670 to Segal. Such pouch type receivers, however, must be either supported by a book of matches such as in Cook or taped to a support surface such as the back of a chair as in Segal. Thus, none of the three types of pouch type receivers are self-supporting. They cannot be conveniently used on a flat level surface such as a table top without additional support. Furthermore, none of the three types of pouch receivers can be conveniently used to support a lighted cigarette in a horizontal position. While Cook discloses the use of key hole slot in the flap of an envelope for holding a lighted cigarette, the entire receiver can hold only one such cigarette. Furthermore, the cigarette cannot be conveniently retrieved from the key hole once it is inserted therein. Rouse discloses the use of a bendable tongue-like flap for closing the pouch type receiver.

In U.S. Pat. No. 4,349,036 Harvey et al. disclose a disposable ashtray comprising an X-shaped permanent base supporting a replaceable liner. The liner has a central trough for storing ash and outwardly extending side flanges with recesses for supporting cigarettes in horizontal positions. The ashtray disclosed by Harvey et al., however, requires a non-disposable X-shaped permanent base which cannot apparently be conveniently carried in pockets or purses.

None of the ash and refuse receivers described above are entirely satisfactory. It is therefore desirable to provide an ashtray which is safe, convenient to use, carry and assemble and of simple and inexpensive construction.

SUMMARY OF THE INVENTION

The ashtray of this invention comprises a folded member having a substantially V-shaped cross-section formed by two panels with a common side. The adjoining sides of the two panels contiguous to the common side are adapted for contact with a supporting surface to support the panels thereon in an upright position, the two sides defining the bottom side of the ashtray. The two panels then define an angular space there between, the angular space having an apical portion near the common side of the panels. The ashtray further comprises an upper member connected to the two panels for supporting cigarettes or cigars in substantially horizontal positions. The upper member is spaced apart from the common side of the panels to allow the lighted ends of cigarettes or cigars to protrude into the apical portion and to allow ashes from such lighted ends to fall through the apical portion towards the bottom side of the ashtray.

The ashtray further comprises a lower member connected to the two panels to hold ashes and refuse and a side member connected to the two panels and the upper and lower members. The side and lower members are of such shape that they, together with the two panels, form a receptacle to securely contain any ash and refuse on the lower member. The two panels and the upper, lower and side members are made of or lined with a fire resistant material.

In the preferred embodiment the two panels of the folded member are moveable relative to each other about their common side. To vary the size of the ashtray as desired, the upper, lower and side members are collapsible so that when the two panels are folded together, smoldering or burning articles contained in the receptacle formed by the two panels and the side and lower members will be extinguished.

The ashtray of this invention is easy to make. First, the V-shaped cross-section folded member described above is provided. Second, a staircase-shaped structure is provided which has an upper member, a lower member and a side member connecting the two members. The ashtray is then formed by connecting the sides of the staircase structure to the two panels so that the upper member is at a higher elevation than the lower member and so that the lower and side member together with the two panels form a receptacle closed at the bottom and the side for securely containing any ash or refuse on the lower member. In the preferred embodiment, the staircase structure is collapsible so that, when the two panels are folded together to collapse the structure, burning or smoldering articles contained by the receptacle will be extinguished.

DETAILED DESCRIPTION OF THE PREFERRED EMBODIMENT

Figure 1:
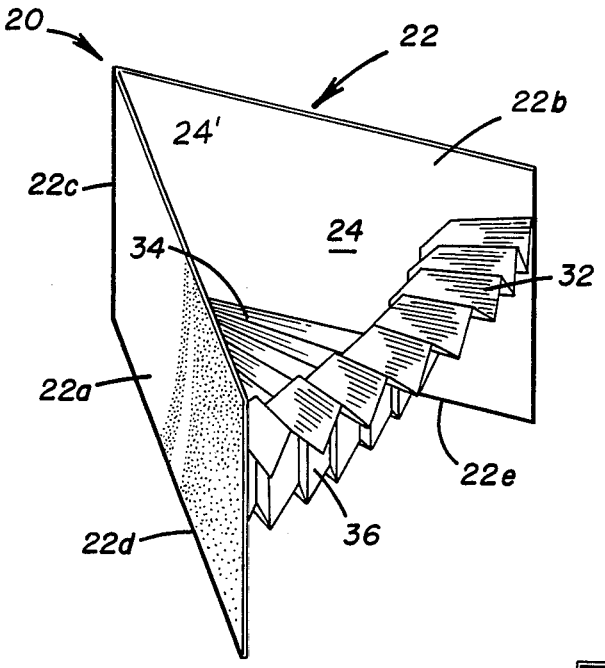
FIG. 1 is a perspective view of an ashtray in an open or unfolded position illustrating the preferred embodiment of the invention.

FIG. 1 is a perspective view of an ashtray illustrating the preferred embodiment of the invention. As shown in FIG. 1 ashtray 20 comprises a folded member 22 which includes two side panels **22*a* and 22*b* having a common side 22*c*. In the preferred embodiment folded member 22 is such that the two side panels are moveable towards or away from each other about their common side 22*c*. Two adjoining sides 22*d*, 22*e* of the two side panels contiguous with the common side 22*c* are shaped to contact a supporting surface to support the two side panels in upright positions as shown in FIG. 1. In the preferred embodiment sides 22*d* and 22*e* are straight edges to be supported by flat supporting surfaces such as table tops or counter tops. Sides 22*d* and 22*e* of the panels define the bottom side of the ashtray. The two side panels include and define an angular space 24 between them. Angular space 24 has an apical portion 24' near the common side 22*c*** of the two panels.

Ashtray 20 further includes an inside assembly connected with the two panels to form the ashtray. The inside assembly includes an upper member 32 connected to the opposing faces of the two panels. The upper member is connected to the two panels at such position so that when the two panels are in the upright positions, the upper member supports cigarette or cigars thereon in substantially horizontal positions. In the preferred embodiment, member 32 itself is substantially horizontal when the two panels are in the upright positions. The upper member, however, is connected to the two panels at such position that it is spaced apart from the common side **22*c* of the panels. Positioned in this manner the lighted ends of cigars or cigarettes (not shown) may protrude into the apical portion 24'** of the angular space between the panels. Ashes (not shown) from such lighted ends will fall through the apical portion towards the bottom side of the ashtray.

Ashtray 20 also includes a lower member 34 connected to the opposing faces of the two panels to hold ashes and refuse. Ashtray 20 further includes a side member 36 connected to the opposing faces of the two panels and the upper and lower members. The side and lower members 36, 34 are of such shape that they, together with the two panels, form a receptacle to securely contain any ash and refuse on the lower member. The opposing faces of the two panels inside the receptacle, the upper, lower and side members are either made of or lined with a fire resistant material.

Figure 15:
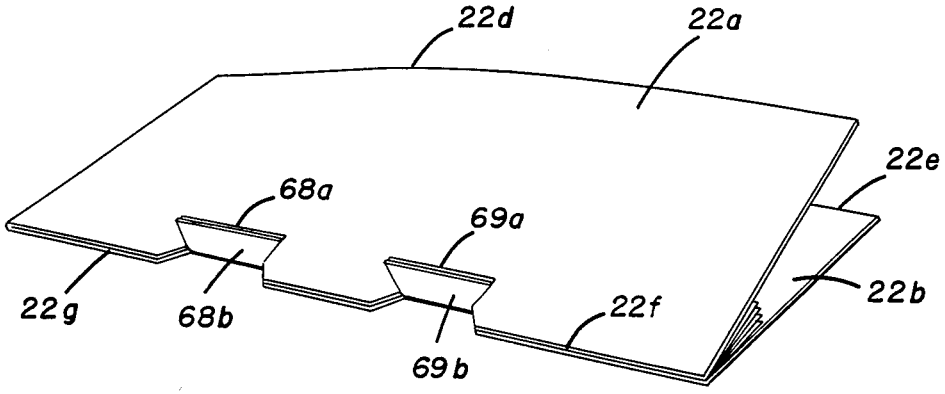
FIG. 15 is a perspective view of the ashtray of FIG. 1 in the folded or closed position to illustrate the compactness of the design.

In the preferred embodiment, the upper, lower and side members 32, 34, 36 are made of a material which are collapsible when the panels **22*a*, 22*b* are folded together so that ashtray 20 is collapsible into a flat compact package as shown in FIG. 15. It will be understood, however, that the upper, lower and side members need not be collapsible, and further that the panels 22***a*, 22*b* of the folded member 22 need not be moveable relative to each other about their common side 22*c*. Thus a non-collapsible ashtray defined by the folded, upper, lower and side members related in the manner described above is also within the scope of this invention.

From the above description it will be evident that ashtray 20 offers many advantages not available with conventional ashtrays such as those described above. Thus, it is found that the folded member 22 with the two side panels having a V-shaped cross-section offers strong and adequate support on supporting surfaces such as table or counter tops. The upper member 32 and the two side panels together allow cigars or cigarettes to be supported in substantially horizontal positions. No additional support members are required. In its folded or closed position as shown in FIG. 15 ashtray 20 is compact and may be conveniently shipped or carried in pockets or purses. When the folded or closed ashtray is ready to be used all one has to do is to move the side panels 22*a*, 22*b* away from each other to the position shown in FIG. 1 or in FIG. 2. No complicated or time consuming steps are required. This is particularly advantageous since a considerable number of smokers may have lighted a cigarette before getting an ashtray or making it ready for use so that only one hand may be available to manipulate the ashtray. Furthermore, where ashtray 22 is collapsible, when a user wishes to extinguish a lighted cigarette, cigar or other articles all that needs to be done is to push the smoldering or burning article onto the lower member 34 and then squeeze the side panels together thereby squashing and snuffing out the smoldering or burning article. In the preferred embodiment the upper, lower and side members are made of aluminum or tin foil. The side panels are made of paper and lined with aluminum or tin foil. Constructed in such manner it has been found that users can snuff out lighted cigarettes or cigars with no safety concerns. Constructed in this manner, the ashtray is inexpensive and is disposable.

Figure 2:
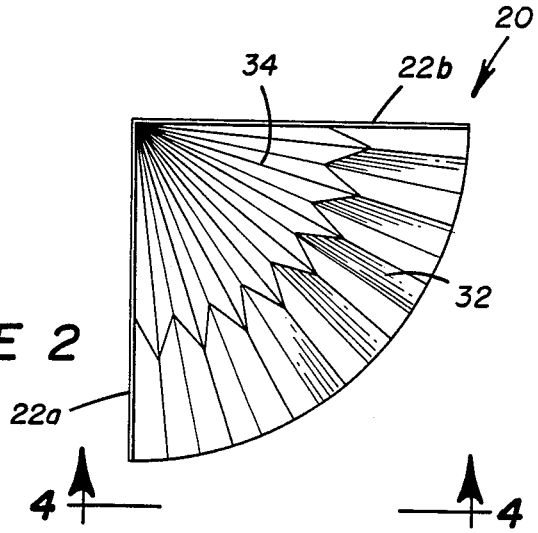
FIG. 2 is a top view of the ashtray of FIG. 1 in the open or unfolded position with the two side panels at about 90 degrees to each other.
Figure 3:
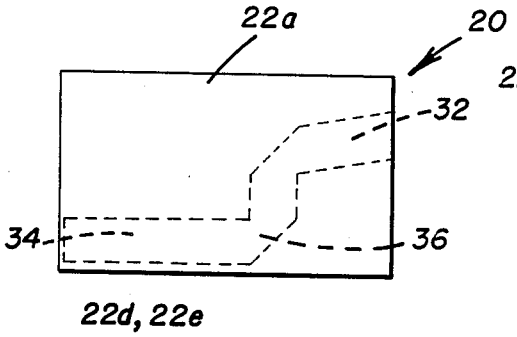
FIG. 3 is a side view of the ashtray of FIG. 1 in the closed or folded position illustrating the different levels of the assembly inside the two side panels.
Figure 4:
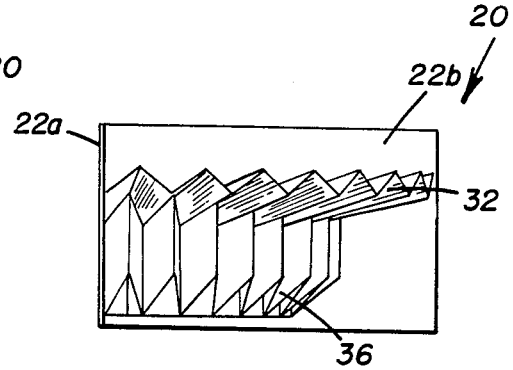
FIG. 4 is a side view of the ashtray of FIGS. 1 and 2 in the open or unfolded position from the direction 4 indicated in FIG. 2.

In the preferred embodiment the upper, lower and side members are corrugated or in the shape of accordion pleats. Such construction of the three members are shown more clearly in FIGS. 2 and 4. FIG. 2 is a top view of the ashtray of FIG. 1 with the two side panels open to about 90 degrees about their common side. FIG. 4 is a side view of the ashtray of FIG. 2 along the direction 4 in FIG. 2. FIG. 3 is a side view of the ashtray of FIG. 1 in the closed or folded position where the dotted lines illustrate the position of the upper, side and lower members 32, 36 and 34. While the upper, lower and side members are shown as corrugated or in the shape of bellows in the preferred embodiment, it will be understood that the three members may be constructed in other manners as well provided that they are also collapsible when the two side panels are folded together. All such configurations are within the scope of this invention.

In the preferred embodiment the lower member 34 is connected to the two side panels at such position that it is above the bottom sides 22*d*, 22*e* as shown in FIG. 3. With the lower member located in such manner smoldering or burning articles on top of lower member 34 are spaced apart from the bottom edge 22*d*, 22*e* so that a heat-insulating layer of air is spaced there between. It has been found that where lower member 34 is so located the bottom edges 22*d* and 22*e* may be held by a user by the palm of his or her hand without causing the user to experience any discomfort.

Figure 5:
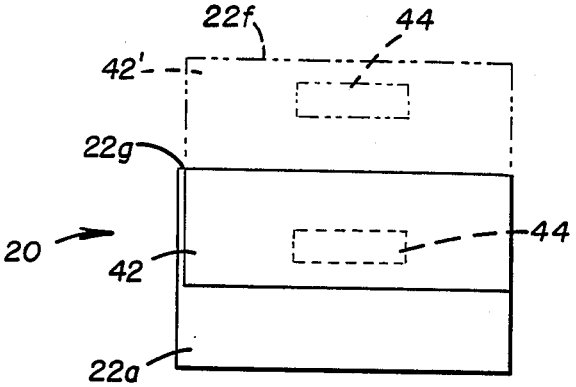
FIG. 5 is a side view of the ashtray of FIG. 1 in the folded position showing one of the two side panels and an optional fold-over type flap with adhesive for locking purposes.
Figure 6:
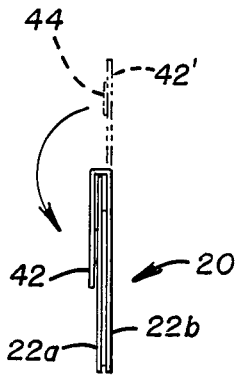
FIG. 6 is an end view of the ashtray and fold-over flap of FIG. 5 with the ashtray in the closed or folded position.

With minor modifications as described below, ashes and refuse in ashtray 20 may be securely contained for convenient disposal or for transportation in pockets or purses so that the ashtray can be reused. Such minor modifications are illustrated in FIGS. 5–9 and FIGS. 11–14. FIG. 5 is a side view of the ashtray of FIG. 1 in the folded position modified to include an optional fold-over type flap with adhesive for locking purposes. FIG. 6 is an end view of the ashtray of FIG. 5. As shown in FIGS. 5 and 6 side panel 22*b* is continued upward at its top side 22*f* into a fold-over flap 42 which has been folded over about the top side 22*g* of panel 22*a* to touch and enclose the top portion of side panel 22*a*. The open position of the flap 42 is shown in phantom in FIGS. 5 and 6. The side of flap 42 for contacting side panel 22*a* is provided with adhesive 44 to glue flap 42 onto side panel 22*a* so as to prevent ashes or refuse in the ashtray from escaping.

Figure 7:
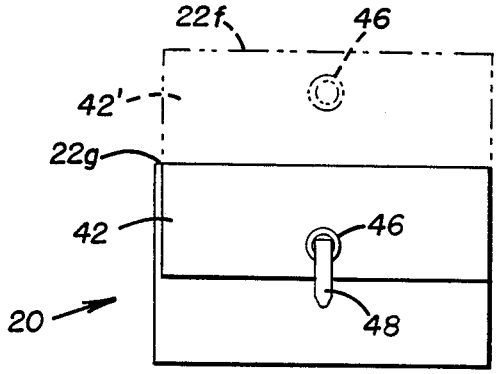
FIG. 7 is a side view of the ashtray of FIG. 1 in the closed or folded position showing one of the side panels and an optional fold-over type flap with a traditional manila envelope type clasp for locking purposes.
Figure 8:
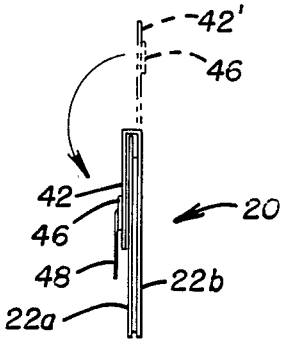
FIG. 8 is an end view of the ashtray and fold-over flap and clasp of FIG. 7 with the ashtray in the closed or folded position.

FIG. 7 is a side view of the ashtray of FIG. 1 in the folded position modified to include an optional fold-over type flap with a traditional manila envelope type clasp for locking purposes. FIG. 8 is an end view of the ashtray of FIG. 7. As shown in FIGS. 7 and 8 the top side 22*f* of side panel 22*b* is again extended upwards to form a fold-over flap 42. The embodiment of FIGS. 7 and 8 differ from that of FIGS. 5 and 6 in that instead of adhesive 44, flap 42 is provided with a hole 46. On the outside surface of side panel 22*a* is attached a traditional manila envelope type clasp 48 positioned to be inserted into hole 46 when flap 42 is folded over to contact side panel 22*a*. After such insertion, clasp 48 is bent over to bind flap 42 to panel 22*a* as shown in FIGS. 7 and 8, thereby securely containing the ashes and refuse inside ashtray 20.

Figure 9:
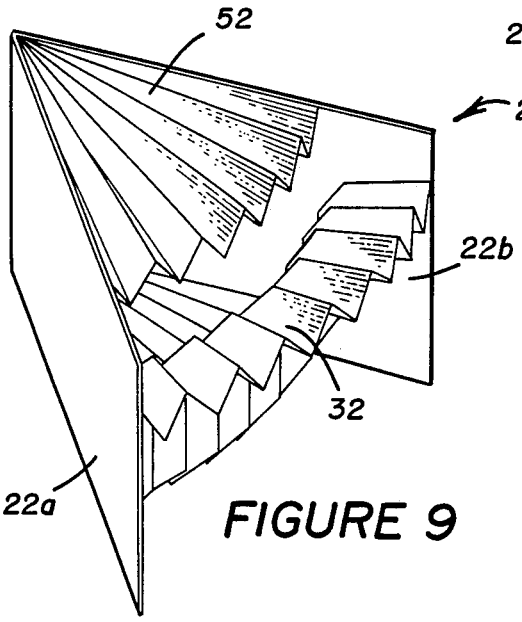
FIG. 9 is a perspective view of the ashtray of FIG. 1 with an optional fluted bellows-type hood positioned slightly higher than the upper or lower members of the ashtray.

FIG. 9 shows yet another modification to the basic design to the ashtray of FIG. 1 to securely contain ashes and refuse. Instead of a flap a fluted bellows-type hood 52 is connected to the opposing faces of the two side panels at such position that the hood is above the upper member 32 when the side panels are in the upright positions as shown in FIG. 9. Hood 52 helps to trap smoke inside the ashtray as well as trap the extinguished smoking material or refuse in the event that the ashtray is closed and returned to a vest pocket, purse, or for safe and sanitary disposal.

Figure 10:
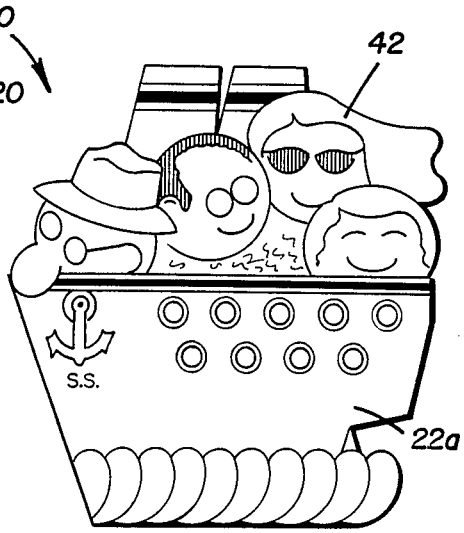
FIG. 10 is a side view of the ashtray of FIG. 1 whose side panel has been modified in shapes desirable for advertising and decoration together with an optional closure flap with decorative design.

FIG. 10 is the side view of the ashtray of FIG. 1 modified to include a decorative design for side panel 22*a* and an optional decorative flap 42 which is again an extension of side panel 22*b*. As shown in FIG. 10 the two side panels and the closure flap may be modified to include decorative designs for decoration or advertising purposes.

Figure 11:
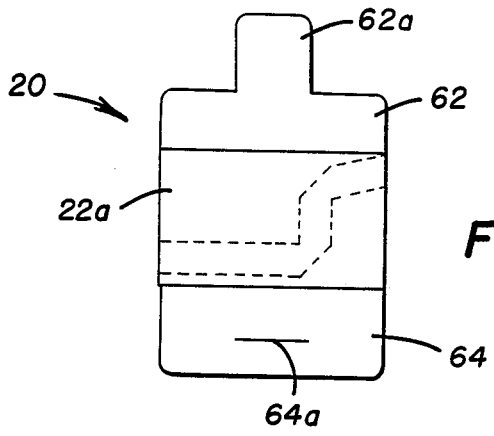
FIG. 11 is a side view of the ashtray of FIG. 1 in the folded or closed position modified to include two optional tongue-and-slot fold-over flaps in the unfolded, unlocked position.
Figure 12:
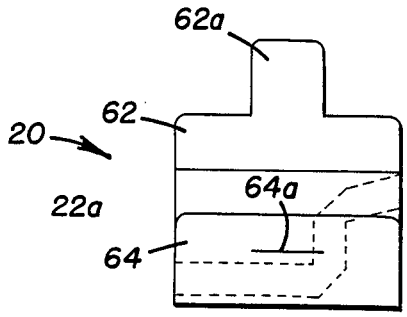
FIG. 12 is a side view of the ashtray of FIG. 11 with the optional slot fold-over flap in the folded position and the optional tongue fold-over flap in the unfolded position.
Figure 13:
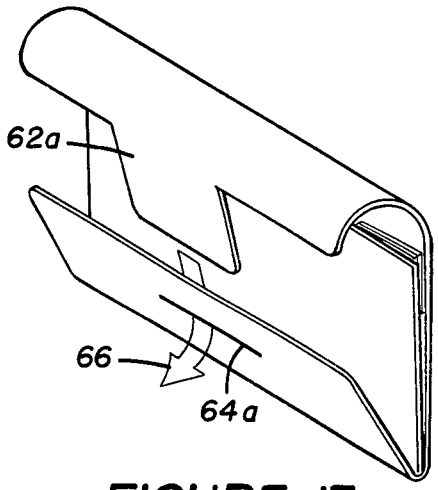
FIG. 13 is a perspective view of the ashtray of FIGS. 11 and 12 showing the optional tongue and slot flaps in the folded and nearly locked position.

FIG. 11 is a side view of the ashtray of FIG. 1 in a closed position modified to include two optional tongue-and-slot fold-over flaps in the unfolded, unlocked position. As shown in FIG. 11 side panel 22*b* is extended in both the top and bottom directions into flaps 62 and 64. Flap 62 includes a tongue portion 62*a* and slot portion 64 includes a slot 64*a*. The tongue and slot portions are connected in reference to FIGS. 12 and 13 to securely contain the ashes and refuse inside ashtray 20. FIG. 12 is a side view of the ashtray of FIG. 11 with the slot flap folded upwards. Tongue flap 62 remains unfolded. FIG. 13 is a perspective view of the ashtray of FIGS. 11 and 12 with both the tongue-and-slot flaps in the folded and nearly locked position. After the two flaps are folded over to their positions as shown in FIG. 13, the tongue or locking portion 62*a* is then inserted along arrow 66 shown in dotted lines in FIG. 13 through slot 64*a* to connect the two flaps.

Figure 14:
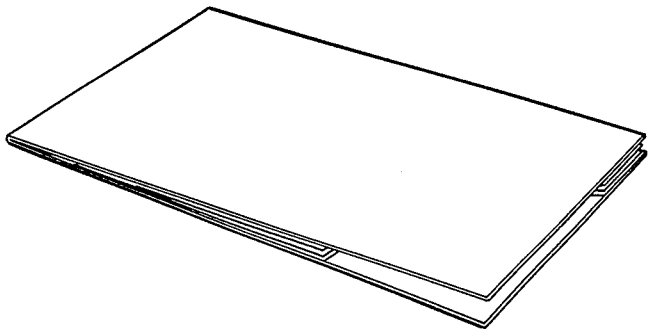
FIG. 14 is a perspective view of the ashtray of FIG. 1 modified to include optional perforated fold-over taps in their locked position.

FIG. 14 is a perspective view of the ashtray of FIG. 1 in the folded position modified to include optional perforated fold-over tabs in the locked position. Thus, as shown in FIG. 14 the top sides 22*f*, 22*g* of the two side panels are both provided with two pairs of fold-over tabs 68*a*, 68*b* and 69*a*, 69*b* trapezoidal in shape. Each pair of tabs are substantially identical in shape so that they could be folded together over to one side to bind the top sides of the two panels together. One or more pairs of such tabs may be provided. As shown in FIG. 14 each panel has two such tabs.

Figure 16:
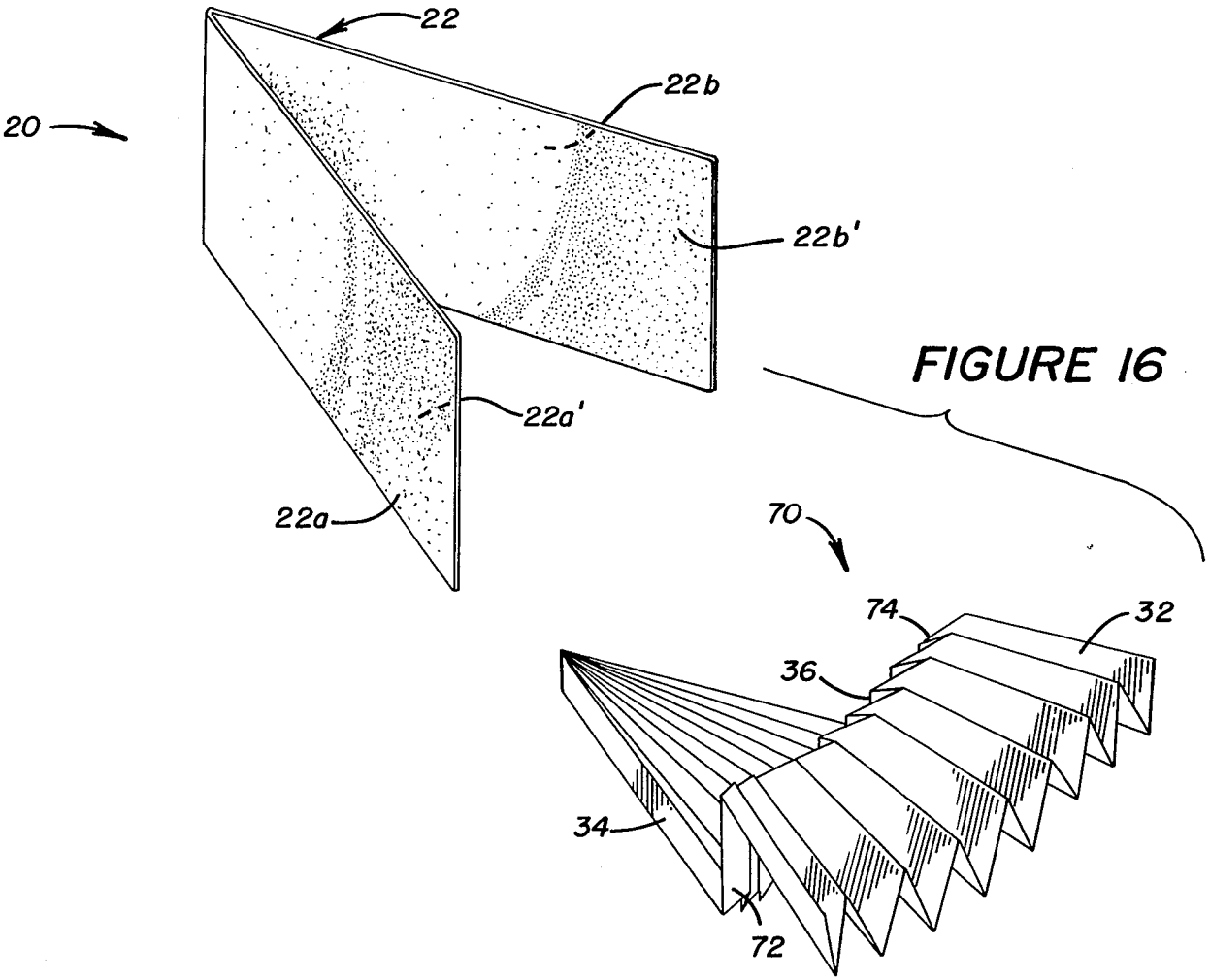
FIG. 16 is an exploded perspective view of the two side panels and the inside assembly comprising the upper, lower and side members to illustrate a method for making the ashtray of FIG. 1.

FIG. 16 is an exploded perspective view of the folded member 22 and the upper, lower and side members, 32, 34, 36 of FIG. 1, illustrating a method of making ashtray 20. As shown in FIG. 16 the upper, lower and side members, 32, 34, 36 may be simply constructed from one sheet of aluminum or tin foil pressed in a conventional manner to form the staircase-shaped structure 70 of FIG. 16. Member 22 may be simply constructed from paper lined with aluminum or tin foil on the inside surface 22*a*′ and 22*b*′. Structure 70 has sides 72 and 74, formed by the adjoining sides of the upper, side and lower members. Sides 72 and 74 are then attached by a conventional means such as gluing to the tin or aluminum lining on the inside surfaces 22*a*′ and 22*b*′ of the two side panels. The manufacture of ashtray 20 is then completed and may be used in the manner described above. Thus, the ashtray of this invention described above is also advantageous because of its simple method of manufacture. The entire ashtray is made of two separate members each of which is simple and inexpensive to manufacture. The ashtray of this invention is also advantageous in that it is sturdy and retains its shape after being used for a number of times. Hence, while in the preferred embodiment the ashtray is designed to be disposable, it is sturdy enough to withstand repeated usages.

The above description of method and construction used is merely illustrative thereof and various changes and shapes, sizes, materials, or other details or the method and constructions may be within the scope of the appended claims.

We claim:

1. An ashtray comprising:

a folded member having a substantially V-shaped cross-section formed by two panels with a common side, the two panels forming two sides of the ashtray, two adjoining sides of the two panels contiguous to the common side adapted for contact with a supporting surface to support the two panels thereon in an upright position, said two sides defining the bottom side of the ashtray, said two panels defining an angular space there between, said angular space having an apical portion near the common side;

an upper member connected to the two panels for supporting cigarettes or cigars in substantially horizontal positions, said upper member being spaced apart from the common side to allow the lighted ends of cigarettes or cigars to protrude into the apical portion and to allow ashes from such lighted ends to fall through the apical portion towards the bottom side of the ashtray;

a lower member connected to the two panels to hold ashes and refuse, said lower member positioned to receive the ashes falling through the apical portion from the lighted ends of cigars or cigarettes supported on the upper member, said lower member being at a lower elevation than the upper member when the two panels are in the upright position; and a side member connected to the two panels and the upper and lower members, the side and lower members being of such shape that they, together with the two panels, form a receptacle to securely contain any ash and refuse on the lower member, said two panels and the upper, lower and side members being made of or lined with a fire resistant material.

2. The ashtray of claim 1, wherein the two panels are moveable relative to each other about their common side, to vary the size of the ashtray, said upper, lower and side members being collapsible so that when the two panels are folded together, smoldering or burning articles contained in the receptacle formed by the two panels and the lower and side members will be extinguished.

3. The ashtray of claim 2, wherein the upper, lower and side members are corrugated so that they are collapsible when folded and so that the entire ashtray is collapsible into a substantially flat package when the two panels are folded towards each other about their common side.

4. The ashtray of claim 1, wherein the upper member is corrugated so that the grooves thereon are each suitable for holding a cigarette or cigar.

5. The ashtray of claim 1, wherein the sides of the two panels opposite to those defining the bottom side of the ashtray define the top sides of the panels and the top side of the ashtray, and wherein one of the two panels has an extended portion at its top side which, when bent along the top side of the other panel, will fold over such side to contact the other panel, said ashtray further comprising an adhesive on the side of the extended portion to contact the other panel so that when the extended portion is bent and folded over to close the top side of the ashtray with the adhesive in contact with the other panel, any ash or refuse in the ashtray will be securely contained therein.

6. The ashtray of claim 1, wherein the sides of the two panels opposite to those defining the bottom side of the ashtray define the top sides of the panels and the top side of the ashtray, wherein one of the two panels has an extended portion at its top side which, when bent along the top side of the other panel, will fold over such side to contact the other panel, said extended portion having a hole therein, said ashtray further comprising a clasp member attached to the other panel positioned to be inserted into the hole in the extended portion when it is bent and folded over to contact the other panel, so that when the clasp is inserted into the hole and bent to hold the extended portion to the other panel, the top side of the ashtray is closed and any ash or refuse in the ashtray is securely contained therein.

7. The ashtray of claim 1, wherein the sides of the two panels opposite to those defining the bottom side of the ashtray define the top sides of the panels and the top side of the ashtray, wherein one of the two panels has a first and a second extended portion, the first extended portion at its top side and the second extended portion at its bottom side, and wherein both extended portions, when bent along the top and bottom sides of the other panel, will fold over such sides to contact each other, one of the two extended portions having a hole therein and the other portion a tongue, the hole being shaped to hold the tongue of the other extended portion, so that when both extended portions are bent and folded over to contact each other by inserting the locking portion into the hole, the top side of the ashtray is closed and any ash or refuse in the ashtray is securely contained therein.

8. The ashtray of claim 1, wherein the sides of the two panels opposite to those defining the bottom side of the ashtray define the top sides of the panels and the top side of the ashtray, wherein each panel has at least one fold-over tab on its top side, said tabs being of substantially the same shape and located at such location on the top sides of the panels that they are foldable together over to one side to bind the top sides of the panels together to close the top side of the ashtray and to securely contain any ash or refuse contained in the ashtray.

9. The ashtray of claim 1, wherein the sides of the two panels opposite to those defining the bottom side of the ashtray define the top sides of the panels and the top side of the ashtray, said ashtray further comprising a hood member connected to the two panels near their top sides for trapping any smoke from lighted cigarettes or cigars supported by the upper member, said hood being collapsible so that when the two panels are folded together, the collapsed hood will close the top side of the ashtray and securely contain any ash or refuse in the ashtray.

10. The ashtray of claim 1, wherein the upper, lower and side members form a staircase-shaped structure withe the upper and lower members forming the upper and lower steps of the structure connected by the side member.

11. The ashtray of claim 1, wherein the lower member is spaced apart from the bottom side of the ashtray thereby enabling the ashtray to be held by hand supporting the bottom side of the ashtray so that any smoldering or burning articles on the lower member will not cause discomfort.

12. A method for making an ashtray comprising:

providing a folded member having a V-shaped cross-section formed by two panels with a common side to form two sides of the ashtray, the two panels being moveable relative to each other about their common side to vary the size of the ashtray, two adjoining sides of the two panels contiguous to the common side adapted for contact with a supporting surface to support the two panels thereon in an upright position, said two sides defining the bottom side of the ashtray;

providing a staircase shaped structure having an upper, a lower and a side member, said upper member adapted for supporting cigarettes or cigars in substantially horizontal positions, said lower member for holding ashes and refuse, said side member connecting the upper and lower members to form the staircase structure, the adjoining sides of the upper, lower and side members defining the two sides of the staircase structure; and connecting the two sides of the staircase structure to the two panels so that, when the panels are in their upright positions, the upper member is at a higher elevation than the lower member, and the side member together with the two panels define an angular space there between closed at the bottom by the lower member, forming a receptacle to securely contain any ash and refuse on the lower member, said two panels and the upper, lower and side members being made of or lined with a fire resistant material, said staircase structure being collapsible so that when the two panels are folded together, smoldering or burning articles contained in the receptacle formed by the two panels and the lower and side members will be extinguished.

* * * * *